US007513084B2

(12) United States Patent
Arguelles

(10) Patent No.: US 7,513,084 B2
(45) Date of Patent: Apr. 7, 2009

(54) PAN TILE FOR ROOFING SYSTEM

(76) Inventor: Daniel Efrain Arguelles, 9455 SW. 78th St., Miami, FL (US) 33173

( * ) Notice: Subject to any disclaimer, the term of this patent is extended or adjusted under 35 U.S.C. 154(b) by 0 days.

(21) Appl. No.: 11/455,346

(22) Filed: Jun. 19, 2006

(65) Prior Publication Data

US 2007/0289242 A1 Dec. 20, 2007

(51) Int. Cl.
*E04D 1/28* (2006.01)

(52) U.S. Cl. ..... 52/519; 52/469; 52/553

(58) Field of Classification Search ..... 52/516, 52/473, 518, 519, 553, 554, 469; D25/140
See application file for complete search history.

(56) References Cited

U.S. PATENT DOCUMENTS

| | | | | | |
|---|---|---|---|---|---|
| 511,859 | A | * | 1/1894 | Montross | 52/461 |
| 540,913 | A | * | 6/1895 | Hille | 52/277 |
| 544,770 | A | * | 8/1895 | Plympton | 52/519 |
| 553,321 | A | * | 1/1896 | Taylor | 52/542 |
| 1,155,559 | A | * | 10/1915 | Franklin | 52/533 |
| 1,251,950 | A | * | 1/1918 | Ames et al. | 52/478 |
| 1,709,376 | A | * | 4/1929 | Shirley | 52/459 |
| 1,826,082 | A | * | 10/1931 | Mastick | 52/519 |
| 1,967,764 | A | * | 7/1934 | Brown | 52/521 |
| 2,079,308 | A | * | 5/1937 | Walton | 52/516 |
| 2,100,505 | A | * | 11/1937 | Gimeno | 52/277 |
| 2,160,548 | A | * | 5/1939 | Kawamura | 52/519 |
| 2,520,499 | A | * | 8/1950 | Golaz | 52/460 |
| 2,984,945 | A | * | 5/1961 | Campbell | 52/478 |
| 3,760,546 | A | | 9/1973 | Martin et al. | |
| 3,848,383 | A | * | 11/1974 | Wilson et al. | 52/533 |
| 3,899,855 | A | | 8/1975 | Gadsby | |
| 4,028,450 | A | | 6/1977 | Gould | |
| 4,544,595 | A | | 10/1985 | Tomason | |
| 4,716,701 | A | * | 1/1988 | Talbot | 52/536 |
| 4,932,184 | A | | 6/1990 | Waller | |
| 5,215,805 | A | | 6/1993 | Pavia, Jr. | |
| 5,392,584 | A | | 2/1995 | Perez-Wilson | |
| 5,465,547 | A | | 11/1995 | Jakel | |
| 5,651,226 | A | * | 7/1997 | Archibald | 52/518 |
| 5,768,831 | A | | 6/1998 | Melchior | |
| 5,837,363 | A | | 11/1998 | Colafati | |
| 6,125,602 | A | * | 10/2000 | Freiborg et al. | 52/560 |
| 6,920,730 | B2 | | 7/2005 | Becker et al. | |
| 2007/0022692 | A1 | * | 2/2007 | Friedman et al. | 52/518 |
| 2007/0289243 | A1 | | 12/2007 | Arguelles | |

FOREIGN PATENT DOCUMENTS

| | | | | |
|---|---|---|---|---|
| FR | 2592673 | A1 | * | 7/1987 |
| GB | 2141157 | A | * | 12/1984 |
| JP | 02016242 | A | * | 1/1990 |
| WO | WO 2007/149369 | A1 | | 12/2007 |

* cited by examiner

*Primary Examiner*—Robert J Canfield
*Assistant Examiner*—Christine T Cajilig
(74) *Attorney, Agent, or Firm*—Malloy & Malloy, P.A.

(57) ABSTRACT

A pan tile for use in a roofing system, wherein a plurality of such pan tiles are disposed in confronting, supported relation on an underlying roof support and in underlying, at least partially supporting relation to plurality of overlapping, exteriorly exposed roof tiles. The pan tile includes a planar base and two oppositely disposed planar side segments extending outwardly from opposite peripheries of said base at a common, preferred obtuse angle. Leading and trailing ends of pan tiles have a greater and lesser transverse dimension respectively, wherein the side segments or oriented in a converging configuration extending from the leading end to the trailing end of the pan tile.

4 Claims, 4 Drawing Sheets

PAN TILE FOR ROOFING SYSTEM

BACKGROUND OF THE INVENTION

1. Field of the Invention

The present invention is directed to a pan tile for use in a roofing system wherein a plurality of pan tiles cover an underlying, supporting roof structure and are collectively oriented to support a plurality of exterior, exposed roof tiles thereon. Each pan tile includes a substantially planar base and oppositely disposed planar side segments cooperatively dimensioned, configured and structured to require a lesser number of both the exposed roof tiles and pan tiles being used to cover a given surface area of the underlying roof structure.

2. Description of the Related Art

In modern day construction, roof covering systems typically include an underlying, supporting deck or like support structure. This underlying support structure is covered by a water proof or leak resistant material that may take various forms. In addition, roofing tiles, shingles and like roof coverings are frequently arranged and secured in overlapping relation to one another so as to collectively overlie the roof deck or like underlying roof support structure. Further, the water resistant covering applied to the outer surface of the roof deck serves to secure the plurality of exterior roof tiles directly to the underlying support. Alternatively, other materials such as cement, polyurethane, etc. may be utilized to secure or fix an underlying layer of roof tiles, shingles, etc. directly to the outer water resistant layer. As such, a roofing system, as generally described above, facilitates a water resistant roofing assembly as well as an outer or exterior, aesthetically pleasing roof covering.

However, one constant and continuous area of concern is the structure and procedure utilized in the installation of a roofing system specifically including the roofing tiles or like roof covering materials. In typical fashion, roof tiles may include an underlying tile disposed in laterally adjacent relation to one another and arranged in longitudinally adjacent rows or columns, especially when the roofing system is applied to a slanted or sloped roof. Moreover, an outer array of roof tiles are disposed in overlapping, at least partially supported relation on the underlying tiles. As such, the underlying tiles and outer roof tiles make up the exposed covering of the roof deck or like underlying roofing support structure.

In known or conventional roofing systems of the type generally described above, it is recognized in the roofing industry that both time and labor associated with installation, as well as the material cost of both underlying tiles and outer, exposed roof tiles are significant and sometimes prohibitive. These costs are especially high when both the underlying tiles and roof tiles are formed of a highly desirable but relatively expensive ceramic material, which are typically hand made or otherwise manufactured to meet customized specifications.

Accordingly, there is a long recognized need in the roofing industry for a roofing system incorporating roofing materials which reduce the cost and time of installation, as well as reduce the cost of materials of a frequently large number of roofing tiles. Such a proposed roofing system should incorporate a pan tile which is dimensioned, configured and structured so as to adequately and effectively cover the underlying roofing support structure while at the same time effectively support the exterior, overlying roof tiles. Moreover, a preferred pan tile could be machine made either from a ceramic or other appropriate material and dimensioned and configured to provide adequate support to the overlying roof tiles. At the same time such a newly proposed pan tile would require a significantly lesser number of both the pan tiles and the conventional roof tiles overlying the improved pan tiles.

Further, the versatility of the proposed pan tile could be such as to serve as an underlying support for a variety of different outer roof tiles specifically including, but not limited to, barrel tiles of the type which are commonly used on domestic dwellings, condominiums and industrial buildings of various styles and designs. Moreover, a roofing system incorporating the preferred and proposed pan tiles of the type described above, should be capable of being secured in overlying relation to the underlying support structure of the roof using any conventional manner including the use of roof installation connectors such as nails, screws, etc or even the more complex connecting wires, clips, or like connectors which facilitate adherence of roofing tiles during extremely high wind conditions. However, when a securing material such as cement, polyurethane, etc. is utilized with a roofing system incorporating a proposed and improved pan tile, a significantly lesser amount of such material should be required thereby further increasing the savings in material costs.

SUMMARY OF THE INVENTION

The present invention is directed to a roofing system and more specifically to the structure of a pan tile, wherein a plurality of such pan tiles are dimensioned, configured and structured to be incorporated in a preferred roofing system. In use, a collection of pan tiles cover and confront a roof deck or underlying support structure of a roof and provide efficient support for exterior roof tiles. Moreover, each of the plurality of pan tiles may be produced by a machine and formed from ceramic or other type of appropriate material. The structuring of the pan tiles and their collective disposition over the underlying roof support is such as to effectively confront, overlie and protect the underlying support of the roof. At the same time a significantly lesser number of roof tiles are required in providing an aesthetically pleasing exterior, exposed roof covering. Accordingly the present invention is directed to a roofing system which may be produced and installed in a manner which accomplishes a reduction in the cost of material and labor when utilized.

More specifically, each of the pan tiles includes a base having an elongated, planar base which may vary in dimension, dependent on the particular application of the roofing system with which the preferred pan tiles are utilized. Further, the base of each pan tile comprises oppositely disposed, spaced apart side segments extending angularly outward from the base. Each side segment extends along a different longitudinal periphery of the base and preferably includes a substantially planar shape or configuration. In a most preferred embodiment of the present invention, the side segments extend outwardly at a common, obtuse angle relative to the base. Therefore, the transverse dimension of the base defines the spacing between the side segments so as to facilitate efficient support of the exterior roof tiles. Concurrently, a greater than normal spacing is provided between the laterally adjacent roof tiles of the roofing system, resulting in less roof tiles being used.

Additional structural features of one or more preferred embodiments of the pan tile include the base preferably having a common transverse dimension along its length. However, the transverse dimensions of the opposite side segments are greater at a leading end of the pan tile and converge, substantially evenly, towards a trailing end of the pan tile. This structuring results in the leading end of the pan tile having an overall greater transverse dimension than the trailing end thereof while the oppositely disposed side segments collectively comprise a converging configuration as they extend from the leading end to the trailing end of the pan tile.

In addition, in order to provide a preferred and/or predetermined collective array of the exterior, exposed roof tiles, typically in overlapping relation to one another, the leading end of the pan tile has a greater height dimension than the trailing end thereof. Such cooperative dimensioning and configuring of the various components of the pan tile facilitate longitudinally adjacent roof tiles being efficiently arranged in an overlapping relation to one another, as is common with roofing tiles having a barrel-type configuration, as well as other types and styles of roofing tiles. Similarly, longitudinally adjacent roof tiles are arranged in rows or columns which are laterally spaced from one another such that the entire underlying support of the roofing structure is covered by the combination of pan tiles and roof tiles.

Accordingly, a distinct advantage provided by the unique structuring of the pan tile of the present invention is the ability to utilize a lesser number of the roof tiles, regardless of their style or shape by increasing the lateral spacing between the various rows or columns of longitudinally adjacent overlapping roof tiles. By way of example, in a typical installation of the roofing system of the present invention, a one hundred sq/ft surface area of a roof deck or like underlying roof support structure may typically include approximately 70 pan tiles, disposed in confronting relation with the outer surface of the underlying roof deck and approximately 60 exterior roof tiles disposed in overlying, supported relation on the pan tiles. In comparison, conventional roofing systems of the type incorporating barrel shaped underlying pan tiles and barrel shaped exposed roof tiles would require approximately 80 pan tiles and 80 exterior roof tiles. Therefore, utilizing the roofing system of the present invention would result in savings in material cost as well as installation time and labor through the elimination of approximately 10 pan tiles and 20 of the possibly more expensive exterior roof tiles, over a commonly sized surface area, if a conventional roofing system were utilized. It should be further noted that in known or conventional roofing systems both the pan tiles as well as the roof tiles are frequently hand made or otherwise customized. Proportional savings in the underlying securing material such as polyurethane, cement, etc. would also add to the overall savings and efficiency of utilizing a roofing system which incorporated a plurality of pan tiles dimensioned, configured and structured in accordance with one or more of the preferred embodiments of the present invention.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
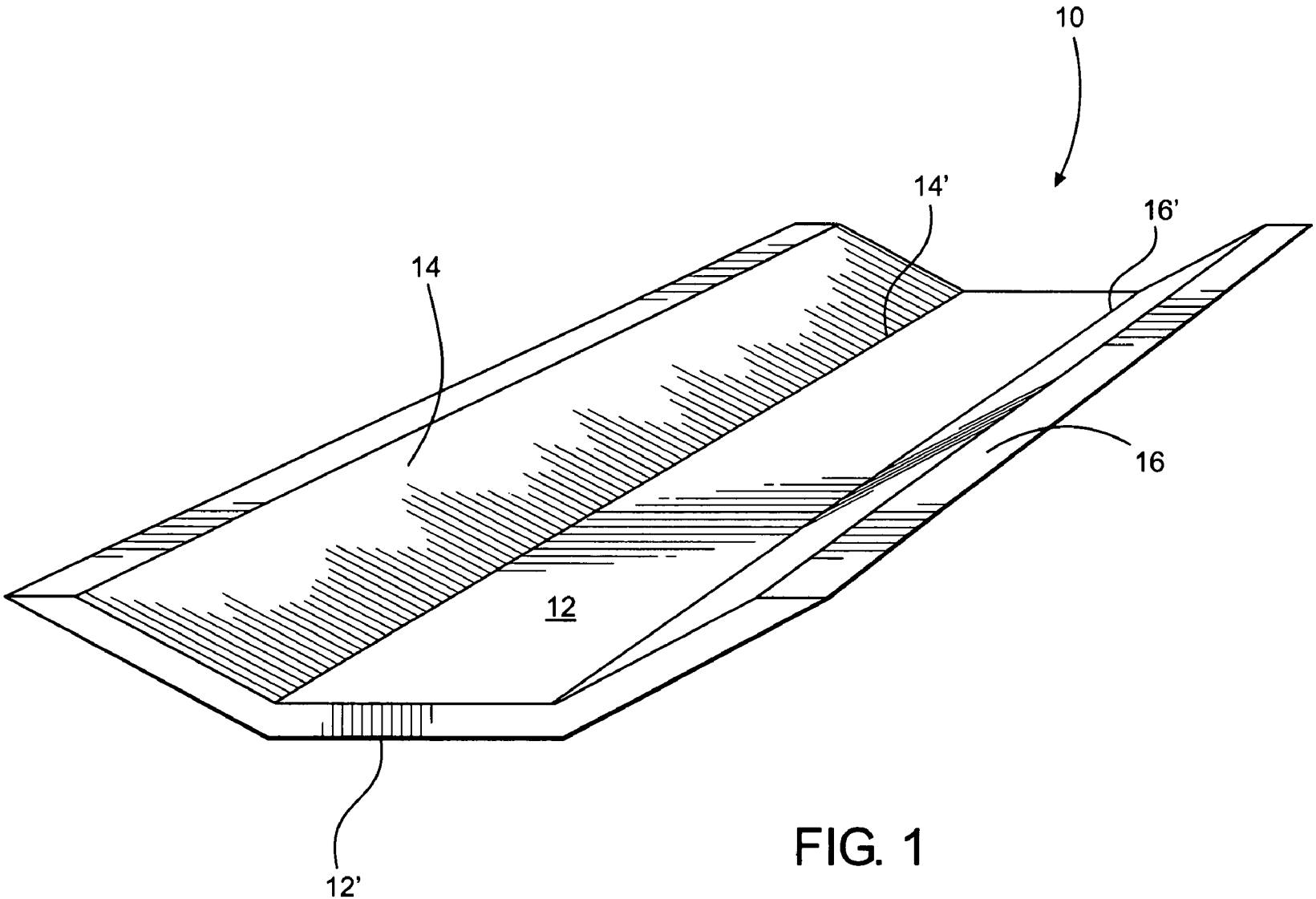
FIG. 1 is a perspective view of one preferred embodiment of a pan tile of the present invention.

The present invention is directed to a pan tile, generally indicated as 10, of the type intended to be used on roofing installations, as well as a roofing system which incorporates a plurality of such pan tiles. As dimensioned, configured and structured the pan tile 10 of the various preferred embodiments of the present invention facilitates the installation of a preferred roofing system and in addition significantly reduces the cost factor of the materials utilized. Therefore the pan tile 10 and roofing system of the present invention overcomes many of the disadvantages and problems associated with known or conventional roofing systems and materials associated therewith.

More specifically, the pan tile 10 of the present invention may be produced or manufactured by a machine, rather than by hand, and may be formed of a ceramic material or other appropriate material which facilitates a reduction in the cost of the plurality of pan tiles utilized. Further, the plurality of pan tiles 10 incorporated in a roofing system are structured to facilitate direct confronting engagement with a roof deck 20 or underlying support on which the exterior, exposed roof tiles 18 of the roofing system are also placed. Moreover, the plurality of pan tiles 10 are adaptive for use with a variety of different styles and types of roof tiles such as, but not limited to, barrel tiles 18 which in typical fashion are disposed in overlying relation to the underlying pan tiles. An additional advantage in the utilization of the pan tile 10, based in part on their dimension, configuration and overall structure, is the reduction in the number of the exterior roof tiles 18 which are required for use over a given surface area of the underlying roofing surface 20 being covered.

More specifically, and as represented in the accompanying Figures, a most preferred embodiment of the pan tile of the present invention is generally indicated as 10 and comprises a base 12 having an elongated configuration and being integrally secured to two side segments 14 and 16. Each of the side segments 14 and 16 preferably extend along the entire length of the base 12 and extend outwardly from opposite peripheral sides or edges 14' and 16' of the base 12 in predetermined angular orientation. In a most preferred embodiment, each of the side segments 14 and 16 extend outwardly from the base 12 at a common, obtuse angle so as to facilitate cooperative positioning and support of spaced apart, laterally adjacent roof tiles 18 as clearly represented in FIG. 7, and as will be explained in greater detail hereinafter.

Figure 4:
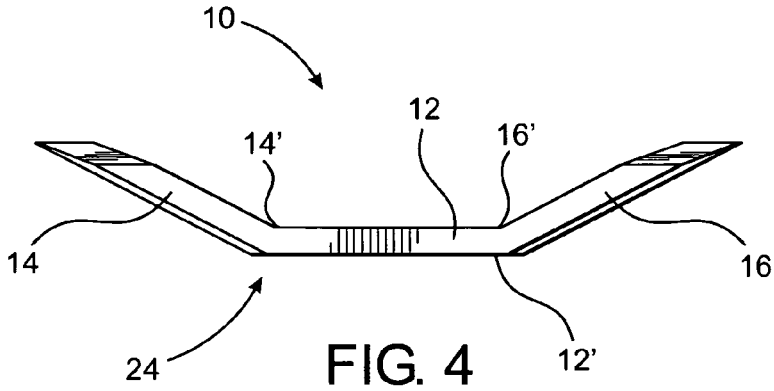
FIG. 4 is an end perspective view of the embodiment of FIGS. 1 and 3.
Figure 5:
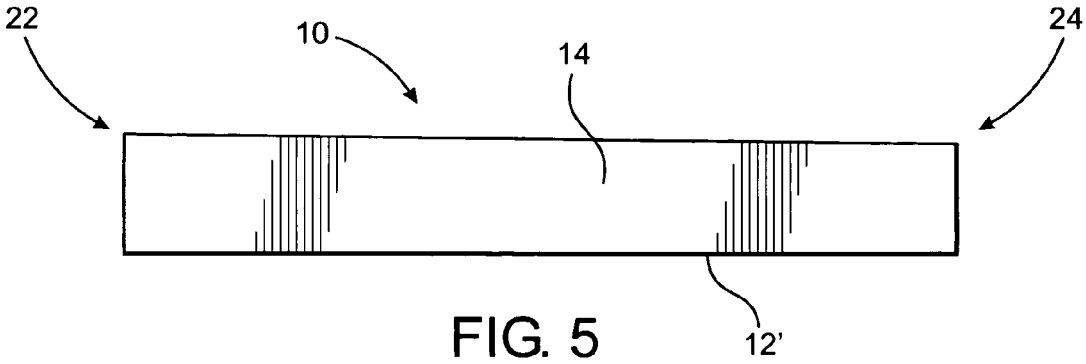
FIG. 5 is a side view of the preferred embodiment of the pan tile as represented in FIGS. 1 and 3.

Additional structural features of each of the pan tiles 10 include the side segments 14 and 16 collectively comprising a substantially converging configuration as the side segments 14 and 16 of each pan tile 10 extend from the leading end 22 to and towards the trailing end 24 and preferably along the entire length of the base 12. Moreover, the leading end 22 of each of the pan tiles 10 comprises a greater height dimension than that of the trailing end 24. Such a variance in height from the leading end 22 to the trailing end 24 is preferably accomplished by a progressively decreasing transverse dimension or height of the side segments 14 and 16 as they extend continuously from the leading end 22 to the trailing end 24, as represented in FIG. 5. Such a variance in the height or transverse dimension of the side segments 14 and 16 is also demonstrated in the opposite end views of FIGS. 3 and 4.

Figure 6:
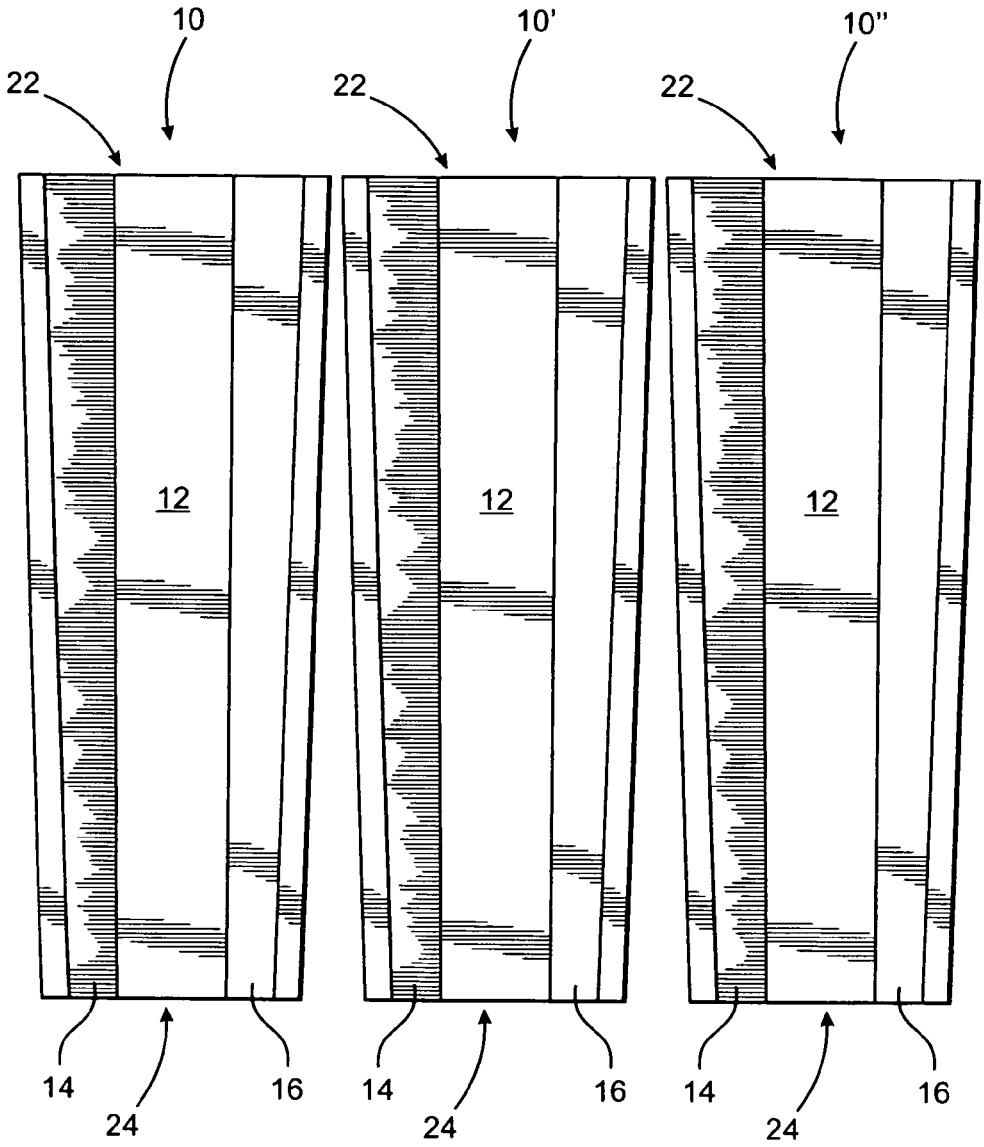
FIG. 6 is a top view of a plurality of pan tiles of the present invention disposed in a predetermined orientation, as practically applied when used in a roofing system.

Other structural and operative features of at least some of the plurality of pan tiles 10 include the base 12 having a substantially planar configuration being further defined by a substantially flat or planar undersurface, as at 12'. As such, the flat or planar undersurface 12' of each of the pan tiles 10 are disposed in engaging, confronting relation to a roof deck or like underlying support structure 20 of the roof. Such confronting engagement of each of the pan tiles 10 with the underlying support 20 facilitates a stable mounting and/or securing of each of the pan tiles 10. In accordance with the roofing system of the present invention, the plurality of pan tiles 10 are disposed in laterally adjacent relation to one another, as represented in FIG. 6.

Figure 4A:
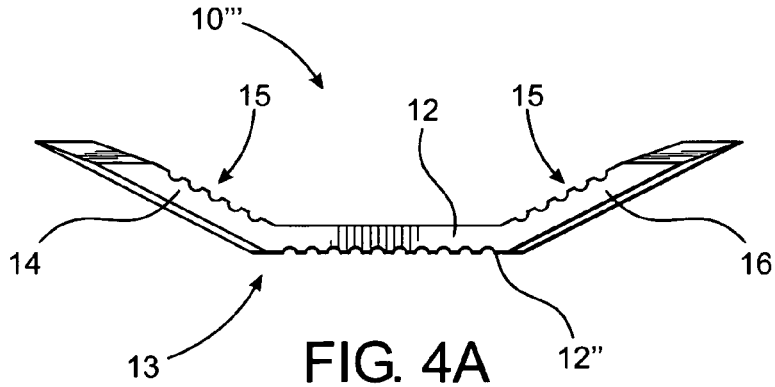
FIG. 4A is an end view in perspective of another preferred embodiment of the pan tile of the present invention similar to but distinguishable from the preferred embodiment of FIGS. 1 and 3.

However, yet another preferred embodiment of the pan tile 10''' of the present invention is represented in FIG. 4A. This embodiment is structurally characterized by a grooved undersurface, generally indicated as 12", of the base 12, wherein the undersurface comprises a plurality of grooves generally and collectively indicated as 13. The grooves 13 are disposed in at least minimally spaced relation to one another and extend along at least a portion of the length of the undersurface 12" As such, one or more of the grooves may extend along a majority of the length or along substantially the entire length of the undersurface 12" of the base 12. The grooves 13 may vary in number, size and overall configuration and may or may not be disposed in a uniform array on the undersurface 12". One purpose of the existence of the grooves 13, which in turn may be at least partially determinative of their number, size, configuration, etc, is the ability to facilitate the adherence of the base to the exposed roof deck or underlying supporting surface of the roof 20. Moreover, the existence of the grooves 13 may provide a more secure interconnection or gripping engagement with a cementitious or other type adhering material which may be disposed between the undersurfaced 12" and the exposed exterior surface of the underlying supporting roof structure 20.

As also represented in FIG. 4A the interior surfaces of the side segments 14 and 16 may also be grooved by including a plurality of elongated, spaced apart grooves generally indicated as 15. As with the plurality of grooves 13, the grooves 15 may vary in number, size, configuration, length, etc. In at least one preferred embodiment represented in FIG. 4A, one or more of the plurality of grooves 15 extend along at least the majority or along substantially the entire length of the inner surface of the side segments 14 and 16. Also, similar to the structure and function of the plurality of grooves 13, the plurality of grooves 15 are provided to better facilitate the securement or connection between a binding or adhering material and the overlying roof tiles, wherein the binding, material is generally disposed into and along a length of the space 19 (see FIG. 7) so as to securely fasten or adhere the overlapping roof tiles 18 to the correspondingly positioned side segments of adjacently positioned ones of the pan tiles 18.

Figure 3:
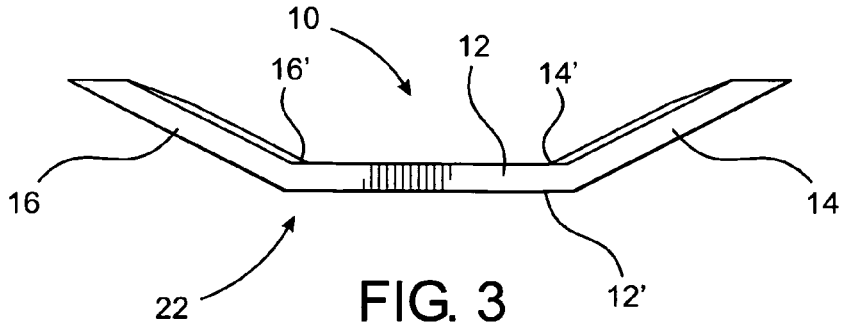
FIG. 3 is an end view of the embodiment of FIG. 1.

It should be further noted that a variation of the preferred embodiment of FIG. 4A may include the plurality of grooves 13 and the plurality of grooves 15, respectively disposed in the undersurface 12" of the base 12 and the inner surfaces of the side segments 14 and 16, being used either independently of one another or in combination with one another. More specifically, there may be practical applications where it is desirable to use the plurality of elongated grooves 13 formed in the undersurface 12" of the base 12, while the plurality of grooves 15 formed in the side segments may not be necessary. Alternatively, there may be additional practical applications wherein the plurality of grooves 15 formed in the inner surfaces of the side segments 14 and 16 are included in the pan tile 10''' and the undersurface of the base 12 is absent the grooves 13 and comprises a flat, planar surface 12', as indicated in FIGS. 3 and 4.

Figure 2:
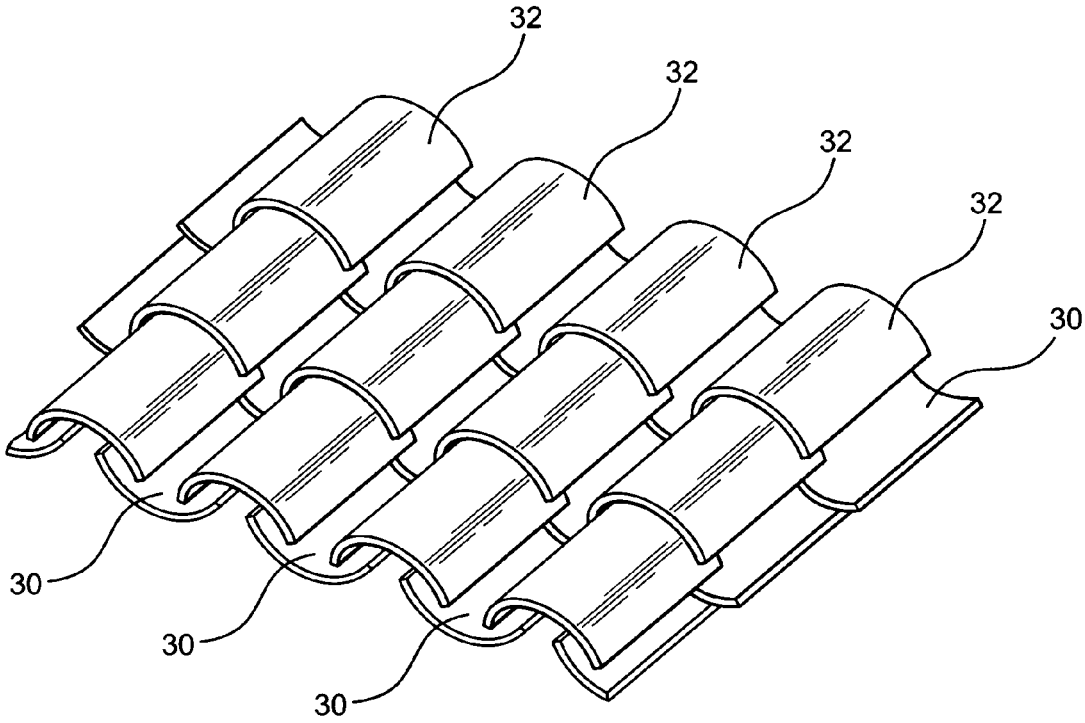
FIG. 2 PRIOR ART
FIG. 2 is a perspective view of a prior art roofing system.

Yet additional structural features of a most preferred embodiment of the present invention comprises each or at least the majority of the pan tiles 10 having a leading end generally indicated as 22 and a trailing end generally indicated as 24. For purposes of clarity the leading end 22 of each of the plurality of pan tiles 10 is disposed substantially "above" the trailing end 24, such as when the plurality of pan tiles 10 are incorporated within a roofing system secured to a sloped or slanted underlying roofing support 20, as is common. Also common to the overall array of both pan tiles and exterior roof tiles is their overlapping orientation or arrangement to longitudinally adjacent tiles, as generally indicated in FIG. 2. As indicated in this prior art representation of conventional curved or barrel shaped tiles 30, longitudinally adjacent tiles are disposed in underlying relation to exterior, overlapping roof tiles 32. As such, longitudinally adjacent ones of the pan tiles 30 are disposed in overlapping relation to one another and are disposed beneath or in an underlying relation to overlapping ones of longitudinally adjacent roof tiles 32.

With further regard to the prior art representation of FIG. 2, and as generally set forth above, the use of barrel shaped pan tiles 30 in underlying, supporting engagement to exteriorly exposed roof tiles 32 results in a greater expense in the installation or use in that both the pan tiles 30 and the exposed roof tiles 32 may be hand made or customized and are typically formed from the same ceramic material. Further, the utilization of the curved or barrel shaped pan tile 30 requires a greater number of both the pan tiles 30 and roof tiles 32, which in turn results in a greater material cost as well as an increased labor cost when installing and/or repairing a conventional or prior art roofing system of the type demonstrated in FIG. 2.

Figure 7:
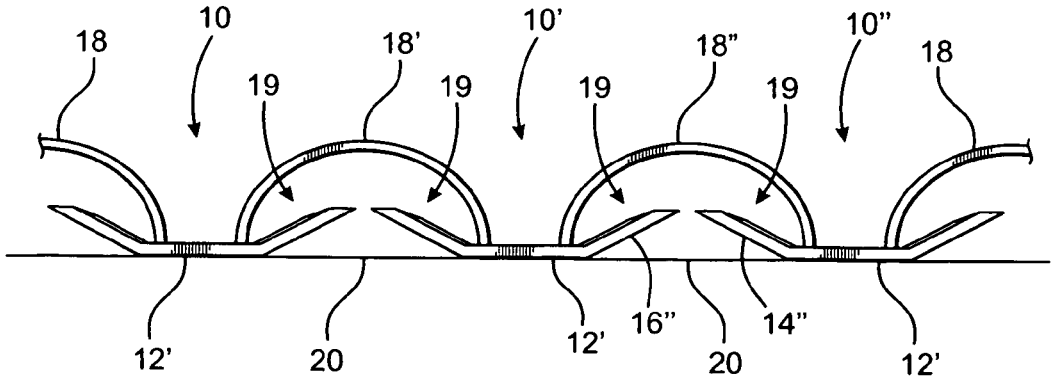
FIG. 7 is an end view of the embodiment of FIG. 6 with a plurality of roof tiles supported on the array of pan tiles.

Also, common terminology used in describing both the conventional roofing system of FIG. 2 and the improved, roofing system incorporating the pan tiles 10 of the present invention both may include the term "longitudinally adjacent" and "laterally adjacent". Accordingly, longitudinally adjacent tiles are those that are arranged in rows or columns extending from a ridge crest of the roof downwardly, wherein laterally adjacent tiles are those that are arranged in adjacent, side-by-side relation to one another. Accordingly, FIGS. 6 and 7 represent a roofing system wherein laterally adjacent tiles 10, 10', and 10" are disposed in side-by-side relation to one another and further wherein laterally adjacent roof tiles 18, 18', 18", etc. are disposed in laterally adjacent but spaced apart relation to one another.

Therefore, additional structuring of the pan tiles 10 which may be incorporated into a roofing system similar to but structurally and operatively distinguishable from the conventional roofing system of FIG. 2, accomplishes the relative overlapping relation between longitudinally adjacent ones of the pan tiles 10 and roof tiles 18 by forming the pan tiles 10 such that the leading end 22 thereof has a greater transverse dimension or width then that of the trailing end 24. Accordingly, the spacing between laterally adjacent pan tiles 10, 10', 10", etc., is represented in FIG. 6. As such, the leading ends 22 have a greater transverse dimension or width and are disposed immediately adjacent and/or in confronting relation to one another. In addition, the trailing ends 24 are orientated at a greater spaced distance from one another. However, as practically applied to the roofing system schematically represented in FIGS. 6 and 7, laterally adjacent pan tiles 10 such as at 10' and 10" are disposed to engage and at least partially support the same roof tile 18". Such engaging support of the roof tile is accomplished by laterally adjacent ones of the pan tiles as at 10' and 10" having correspondingly disposed side segments 16" and 14" being oriented in underlying relation and at least partially on the interior of the commonly supported roof tile 18".

The relative positions and/or orientations of the pan tiles 10, 10', 10", etc. is such that a greater spacing will be created between the laterally adjacent roof tiles 18, 18', 18", etc. due to the overall structure of each of the respective pan tiles 10, 10', 10", having a flat or planar configuration of the respective bases 12. Also additional stability is provided by the confronting relation or engagement of the flat undersurface 12' or the grooved undersurface 12" with the exposed surface portion of the underlying roofing support structure 20. As such, the entire exposed outer surface area of the underlying support 20 will be adequately and appropriately covered by the roofing system as demonstrated in FIG. 7. Also, a significantly lesser amount of cementitious or other type adhering material such as polyurethane, cement, etc. may be utilized to secure the pan tiles 10 or 10'" to the underlying support 20, when such securing or adhering material is utilized. Clearly, other installation techniques and processes may be used to secure the pan tiles 10 to the underlying support 12, as well as secure the roof tiles 18 to the pan tiles 10 to the underlying support 20 and one another.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A roofing system comprising:

a plurality of pan tiles structured for placement on an underlying support of a roof in a laterally non-overlapping fashion, said plurality of pan tiles collectively disposed and structured in underlying, at least partially supporting relation to a plurality of roof tiles disposed in overlying relation to laterally adjacent ones of said pan tiles such that non-overlapping opposite longitudinal peripheries of said pan tiles share a common roof tile, each of said pan tiles including a base having a common transverse dimension extending along a length of said base and two side segments, at least a majority of said pan tiles comprising a leading end and a trailing end with said leading end comprising a greater transverse dimension than said trailing end, said base having a substantially planar configuration and a flat exterior surface disposed in supported, confronting engagement with the underlying support, at least a majority of said pan tiles comprising said base having a substantially uniform transverse dimension along its entire length, each of said side segments extending along an opposite longitudinal periphery of said base and structured for non-overlapping spaced apart relation to correspondingly disposed side segments of a laterally adjacent one of said plurality of said pan tiles, each of said side segments comprising a planar configuration and extending uniformly outward from and along the length of said base at an obtuse angle relative to said base, and said side segments of said pan tiles collectively comprising a converging configuration extending from said leading end to said trailing end.

2. A roofing system as recited in claim 1 wherein each of said side segments extends along substantially an entire length of said base.

3. A roofing system as recited in claim 2 wherein each of said side segments is integrally secured to said base.

4. A roofing system as recited in claim 1 wherein at least a majority of said pan tiles comprise said leading end having a greater height dimension than said trailing end thereof.

* * * * *